United States Patent [19]

Bechtold

[11] 4,408,422

[45] Oct. 11, 1983

[54] SKYLIGHT DOME ASSEMBLY

[76] Inventor: Stephen K. Bechtold, 28 Soundview Ave., East Northport, N.Y. 11731

[21] Appl. No.: 387,215

[22] Filed: Jun. 10, 1982

[51] Int. Cl.[3] ..... E04B 7/18

[52] U.S. Cl. ..... 52/72; 52/209; 52/302

[58] Field of Search ..... 52/200, 788, 72, 19, 52/58, 303, 302, 209, 97, 22; 98/2.14, 37, 13

[56] References Cited

U.S. PATENT DOCUMENTS

| | | | |
|---|---|---|---|
| 2,875,710 | 3/1959 | Bechtold | 52/58 |
| 3,473,276 | 10/1969 | Back | 52/200 |
| 4,073,097 | 2/1978 | Jentoft | 52/22 |

FOREIGN PATENT DOCUMENTS

| | | | |
|---|---|---|---|
| 2407254 | 8/1975 | Fed. Rep. of Germany | 52/200 |

*Primary Examiner*—John E. Murtagh
*Attorney, Agent, or Firm*—Scully, Scott, Murphy & Presser

[57] ABSTRACT

A skylight assembly is provided to be mounted to cover an opening in a roof structure. The assembly includes a liner adapted to be mounted adjacent the edge of the opening in the roof structure around the periphery to surround the opening and to form a wall extending upward from the roof structure. An outer dome and an inner dome are provided with the domes spaced and the outer dome overlying the inner dome. Both of the domes engage a sealing gasket positioned on the liner wall. A supporting frame is coupled to the dome and sealing gasket arrangement and the frame and arrangement are hinged to the liner to permit shifting thereof with respect to the liner between a closed position overlying the opening in the roof structure and an open position permitting access to the opening from the exterior of the roof structure. The supporting frame has a U-shaped end portion to receive the peripheral edge portion of the outer dome therein and thereby support the outer dome. The manner of engagement between the frame and the outer dome enables the assembly to resist significant tension forces. A weep hole is provided in the frame to alleviate the danger of condensation in the portion of the outer dome enclosed by the frame and gasket. The exposed peripheral edge of the outer dome is protectively enclosed.

8 Claims, 3 Drawing Figures

SKYLIGHT DOME ASSEMBLY

BACKGROUND OF THE INVENTION

Skylight technology has advanced rapidly in recent years. As a result, a variety of different types of skylights have been adapted to many environments, for example, roof structures of buildings and vehicles. Certain designs are permanently sealed and others are designed to be opened and closed as desired for ventilation purposes.

The types that open and close are generally more sophisticated and many designs have been developed to enhance the ease of opening and closing of the skylight while maintaining a weather proof and leak proof structure which has low manufacturing cost and is dependable and easy to use over a prolonged period of time.

The structures are usually designed to be permanently mounted in a roof structure. They must be versatile and easy to install in a finished roof whether it be as part of initial construction or in an existing roof. Cost is virtually always a factor that is given careful consideration. Recent successful skylight designs of the type under consideration are disclosed in prior U.S. Pat. Nos. 2,875,710 and 3,093,613. A consideration of these two disclosures show the manner in which skylight designs have progressed over the past 20 years. The present invention represents desirable modifications in the same type of structure.

SUMMARY OF THE INVENTION

Thus, with the above background in mind, it is among the primary objectives of the present invention to provide an improved skylight assembly for a roof. In particular, the skylight assembly is formed with a double dome window portion shiftable between a position overlying an opening in the roof and a position permitting access to the opening in the roof from the exterior of the structure. The domes are spaced for insulation purposes and permit passage of light into the interior of the structure.

It is an objective of the present invention to provide a supporting frame with a U-shaped projecting end to capture the peripheral edge portion of the outer dome in surrounding interengagement. In this manner, the outer dome is supported so that the assembly can be subjected to a substantial amount of tension. Furthermore, adjustments in the assembly can be made at the location of use if necessary. Also, since the peripheral edge portion of the outer dome is totally enclosed, there is no danger from projecting plastic edges on the assembly.

A further objective is to provide a supporting frame for enclosing the projecting end portion of the outer dome of the skylight assembly with at least one weep hole in the frame for communication between the edge portions of the outer dome and the atmosphere and to alleviate the possibility of condensation forming in the enclosed end portions of the outer dome of the assembly.

The supporting frame is formed with a central base portion bounding the circumference the assembly. The frame has one leg extending from one transverse edge of the base and being perpendicular to the base along the length thereof and is adapted to be captured by a receiving slot in a sealing gasket. The frame has a second leg extending from the other transverse edge along the length of the supporting frame and terminating in an arcuate U-shaped free end adapted to receive the peripheral edge portion of the outer dome therein. The second leg including a plurality of weep holes permitting access to atmosphere for the cavity formed in the portion of the assembly between the supporting frame and the outer dome and thus eliminating the danger of condensation collecting therein.

It is an objective of the invention to provide a sealed assembly with a pair of spaced domes engaging a circumferential sealing gasket or extrusion and a supporting frame mounted to the extrusion and dome assembly around the periphery thereof. The supporting frame, domes and sealing gasket arrangement are hinged to a liner adapted to be mounted in an opening in a roof structure. The liner is formed as a multi-walled structure with a central aperture aligned with the opening in the roof structure and the central portion of the two domes so that light can pass therethrough. The sealing gasket is positioned on the upper edge of the liner and has an inner slot to capture and mount the peripheral edge of the inner dome. A second outward slot in the gasket receives in sealing engagement an extending leg of a supporting frame. The outer dome is formed with a seating portion intermediate its center and its peripheral edge. The seating portion is adapted to rest in sealing engagement on the upper surface of the gasket. The portion of the upper dome between the seating portion and its peripheral edge extends as a skirt beyond and overlying the liner. The supporting frame has a second leg terminating in a U-shaped configuration to capture and hold the peripheral edge portion of the outer dome. Weep holes in the supporting frame alleviate the possibility of condensation forming in this area at the underside of the skirt portion of the outer dome between the sealing gasket and the peripheral edge of the outer dome.

The supporting frame can be formed as a single unitary member having an elongated central base portion extending around the periphery of the assembly and including a first leg extending from a transverse edge of the base portion along its length and perpendicular thereto. A second leg extends from the other transverse edge of the base portion along the length of the base portion and perpendicular thereto. The two legs extend in opposite directions. One leg is sealingly captured in the sealing gasket or extrusion and the other leg terminates in a U-shaped edge for capturing and supporting the peripheral edge portion of the outer dome.

Alternatively, the supporting frame can be formed of two L-shaped members with a leg of each of the L-shaped members being in overlying adjacent position with one another and coupled by appropriate fastener assemblies. The other leg of each of the L-shaped members extends perpendicular to the overlying fastened legs with the two extending legs oppositely directed so that one leg can be mounted within the sealing gasket and the other leg can support the peripheral edge portion of the outer dome.

It is contemplated that the U-shaped free end of the supporting frame can be formed with an arcuate configuration or a multi-sided configuration.

A further objective is to provide a skylight dome assembly with minimum manufacturing, installation, and maintenance costs. By supporting the outer dome within the U-shaped extending portion of the supporting frame, the increase in support strength, particularly in regard to tension forces on the assembly permits a cost serving in material cost. The components can be formed of fine engagement materials than previously possible. Furthermore, the strength of the assembly is enhanced by the fact that there are no requirements for holes to be formed in the dome members for mounting or fastening purposes. Thus, without punctures in the domes, the danger of consequent stress points is eliminated. This is particularly helpful when dealing with molded plastic material, such as plexiglass.

In summary, a skylight assembly is provided to be mounted to cover an opening in a roof structure. The assembly includes a liner adapted to be mounted adjacent the edge of the opening in the roof structure around the periphery to surround the opening and to form a wall extending upward from the roof structure. An outer dome and an inner dome are spaced from one another and the outer dome overlies the inner dome. Both of the domes engage sealing means positioned on the liner wall. A supporting frame is coupled to the dome and sealing means arrangement and the frame and arrangement are hinged to the liner to permit shifting thereof with respect to the liner between a closed position overlying the opening in the roof structure and an open position permitting access to the opening from the exterior of the roof structure. The supporting frame has a U-shaped end portion to receive the peripheral edge portion of the outer dome therein and thereby support the outer dome.

With the above objectives among others in mind, reference is made to the attached drawings.

DETAILED DESCRIPTION

Figure 1:
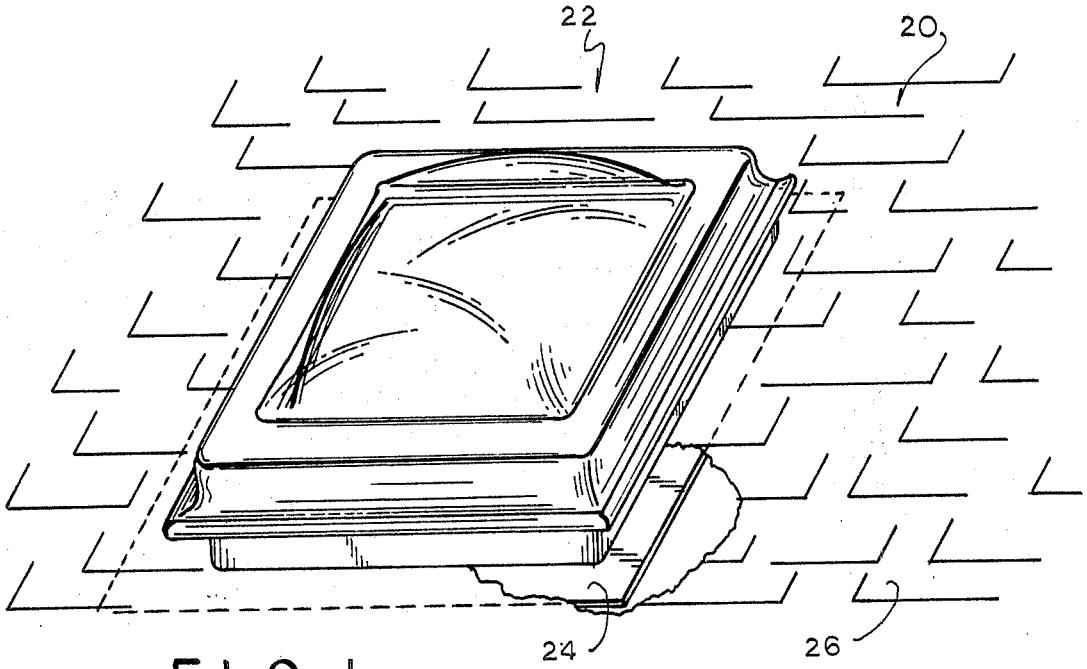
FIG. 1 is a plan view of a skylight assembly of the invention mounted on a roof.
Figure 2:
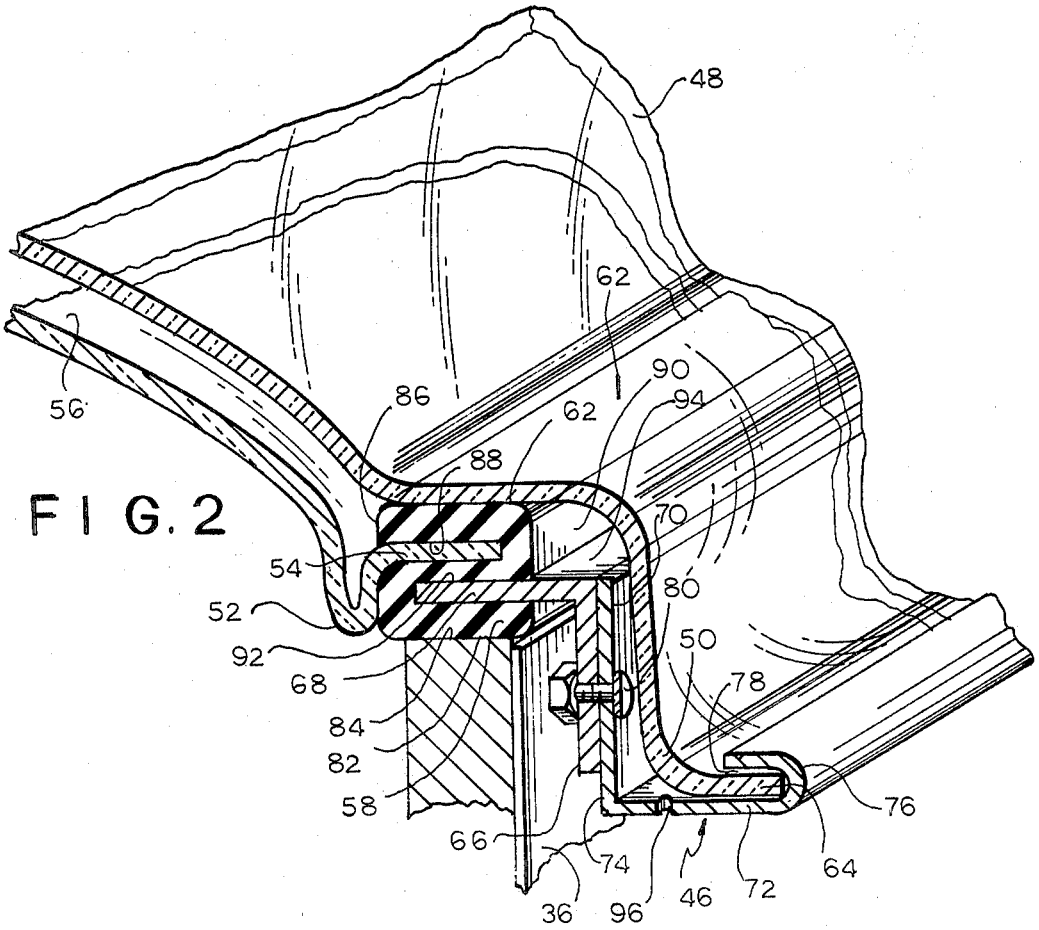
FIG. 2 is an enlarged fragmentary sectional view of the skylight assembly taken along the plane of line 2—2 of FIG. 1.
Figure 3:
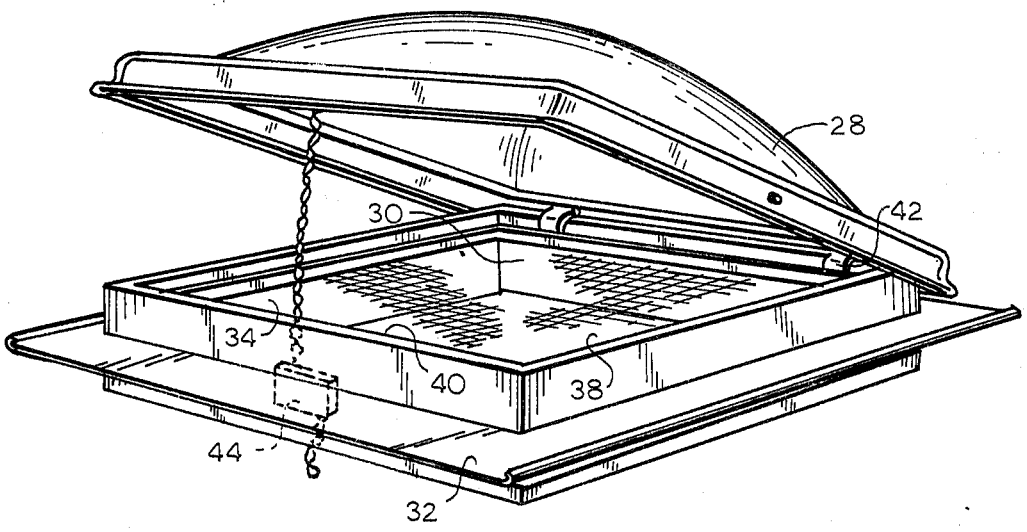
FIG. 3 is a perspective view of the skylight assembly mounted on a roof and in the open position.

Roof 20 is shown with skylight assembly 22 of the present invention mounted thereon. Roof 20 includes conventional roof sheathing 24 covered by an overlay of conventional shingles 26.

Skylight 22 includes a swinging window unit 28, box-like frame or liner 30, and a flashing frame 32.

Box-like liner 30 includes four adjoining side walls 34 arranged in a rectangular or square configuration to form an aperture therebetween. The walls 34 can be formed of conventional material such as wood, for example plywood, or metal.

The sheet of flashing 32 is mounted on the roof surface in a conventional manner between the sheathing 24 and the shingles 26 and has a portion 36 engaging walls 34 by extending up the walls and over the upper edge and is affixed in a conventional manner in that position. The flashing is arranged to surround an opening 38 in the roof and the frame or liner 34 also surrounds the periphery of opening 38 in the roof so that the aperture 40 in the frame is aligned with the opening 38 in the roof structure. A suitable screen can be conventionally mounted on the interior of the walls 34 to overlie opening 38 in the roof structure and extend across aperture 40 in the liner 30.

The swing away window unit 28 is mounted on one of the walls 34 of the liner 30 by the use of suitable hinges 42. The side of the window unit 28 opposite the side connected by hinges 40 is provided with a suitable operating unit 44 for opening and closing of the window unit 28 with respect to the liner 30 as it rotates about hinges 42. The operating unit 44 can be a well known type of handle, pull or motorized unit.

Window unit 28 includes a peripheral supporting frame 46 surrounding walls 34 of the liner 30 when the frame 46 is lowered to a surrounding side by side relationships with the walls 34 when skylight is closed. Supported by frame 46 is an outer dome-shaped or exteriorally convex-like transparent window 48. In this connection, window 48 may be formed from a suitable resinous material commercially employed for such purposes. Outer dome or window 48 preferably terminates along its periphery in a depending integral skirt 50. Frame 46 can be formed of a conventional well known material, for example, aluminum or stainless steel. Outer dome 48 can be formed, for example of clear acrylic plexiglass.

Window 48 forms an outer dome which is spaced from an inner insulating dome 52 of similar material which is preferably clear or white translucent. The peripheral edge portion 54 of inner dome 52 is sealed as is the peripheral end portion 50 of outer dome 48. Insulation is facilitated by the insulating space 56 between the inner and outer domes.

An extrusion or gasket 58 of conventional sealing material such as rubber is used to seal the peripheral portions of the double dome structure. Outer dome 48 has an intermediate end portion 60 resting on the upper surface 62 of extrusion 58 and the peripheral edge portion 64 is anchored by the supporting frame 46. This is accomplished by the means of the configuration of supporting frame 46.

Supporting frame 46 includes an elongated central base portion 66 which is aligned and slightly spaced from the adjacent wall 34 of liner 30 around the circumference of the assembly. The elongated base 66 has a first leg 68 extending inwardly from the upper transverse edge 70 of the base 66 along its length. A second leg 72 extends laterally outward from the other transverse edge 74 of the base along its length in a direction perpendicular to the plane of the base 66. Leg 72 extends in the direction opposite to leg 68.

The free end of leg 72 is curved into a U-shaped end portion 76 so that a recess 78 is formed to receive the peripheral edge portion 64 of the outer dome 48. Alternatively, instead of an arcuate configuration, U-shaped end portion 76 can be formed as a multi-sided U-shaped structure.

Frame 66 is formed of two elongated L-shaped members with the leg of one L-shaped member engaging and aligned with a leg of the other L-shaped member so that the two adjacent abutting legs together form base portion 66. They are held together by a plurality of conventional nut and bolt assemblies 80 passing through aligned apertures in the adjacent legs of the L-shaped members. The free leg of one of the L-shaped members forms first leg 68 of base 46 and the free leg of the other L-shaped member forms leg 72 of the frame 46. Alternatively, the frame 46 can be formed of one single unitary piece with the same configuration.

Gasket 58 has its undersurface 82 seated on the upper edge 84 of the walls 34 of liner 30. Gasket 58 also rests on the exposed upper surface of hinges 42 mounted to liner 30 as the gasket extends around the periphery of the skylight assembly 22 and seals the interior.

The inner side wall 86 of gasket 58 includes an elongated longitudinal slot 88 to receive the peripheral edge portion 54 of inner dome 52 therein in sealing interengagement. The arcuate portion of inner dome 52 adjacent to peripheral edge portion 54 is engaged with inner side wall 86, as shown, or at least closely adjacent thereto.

The outer side 90 of gasket 58 includes a similar elongated longitudinal recess or slot 92, similar to slot 88, positioned below slot 88 and having leg 68 of supporting frame 46 mounted therein in sealing interengagement therewith.

This arrangement produces an internal cavity 94 between frame 46, gasket 58 and the interior of outer dome 48. In order to avoid collection of moisture and condensation in cavity 94, a plurality of weep holes 96 are formed in leg 72 spaced around the periphery of the skylight. This provides access to atmosphere for cavity 94 and overcomes any potential moisture collecting areas in the assembly. The number of weep holes 96 is a matter of choice and can be spaced in any desired point around the periphery of skylight assembly 22 and they can be formed in any of the portions of supporting frame 46 exposed to atmosphere.

It should be noted that the outer dome is supported at its peripheral edge portion 64 by the U-shaped end of leg 72 of the supporting frame. Thus, the assembly 22 can be subjected to significant tension loads without danger of failure of any of the components. Adjustment of the skylight assembly in use on the roof structure is also easily and effectively accomplished. Furthermore, totally enclosing peripheral edge 64 of the outer dome allows the skylight to satisfy any existing codes concerning exposed plastic edges. Also, the extra support afforded by the assembly permits the use of smaller gauge components thus resulting in significant material savings. Also, since no holes need be formed in either dome 48 of dome 52 in order to assemble the skylight, no consequent stress points are formed. This is particularly valuable particularly in dealing with material such as plexiglass.

In use, the roof structure 20 is prepared in a conventional manner by forming an opening 38 in the roof surface and preparing the sheathing 24 and shingles 26 for receipt of the unit 22.

Flashing sheet 32 is mounted to the roof and surrounds opening 38 and the aperture 40 in liner 30 is also aligned with opening 38 in the roof. This causes alignment between the domes of the window unit 28 and the opening in the roof. The window portion 28 can be opened and closed as desired by using operator 44. A screen 40 will protect the opening 38 in the roof when the window unit is shifted to the open position.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

I claim:

1. A skylight assembly adapted to be mounted to cover an opening in a roof structure comprising: a liner adapted to be mounted adjacent the edge of the opening in the roof structure around the periphery to surround the opening and to form a wall extending upward from the roof structure, an outer dome and an inner dome spaced from one another and with the outer dome overlying the inner dome, both of said domes engaging sealing means positioned on the liner wall, a supporting frame coupled to said dome and sealing means arrangement and the frame and arrangement being hinged to said liner to permit shifting thereof with respect to the liner between a closed position overlying the opening in the roof structure and an open position permitting access to the opening from the exterior of the roof structure, the supporting frame having a U-shaped end portion to receive the peripheral edge portion of the outer dome therein and thereby support the outer dome, the sealing means being a gasket positioned around the upper peripheral surface of the wall of the liner, the inner side of the gasket having a slot therein adapted to receive and seal the peripheral edge of the inner dome, the outer side of the gasket having a slot therein to sealingly engage the supporting frame attached to the outer dome, and a portion of the outer dome inwardly spaced from its outer peripheral edge resting on the upper side of the gasket.

2. The invention in accordance with claim 1 wherein flashing means is mounted in the area of joinder between the liner and the roof structure.

3. The invention in accordance with claim 1 wherein the inner and outer domes are transparent and are molded with conforming configurations over the portions thereof adjacent to one another and overlying the opening in the roof structure.

4. The invention in accordance with claim 1 wherein the supporting frame includes at least one weep hole therein providing communication from the cavity formed between the frame and the underside of the outer dome to the exterior of the assembly, and each weep hole providing a passageway for air and moisture collected between the frame and the undersurface of the outer dome.

5. The invention in accordance with claim 1 wherein the frame is formed with an elongated central base, a first leg extending from one transverse edge of the base along the length thereof and perpendicular thereto, a second leg extending from the other transverse edge of the base along the length thereof and perpendicular thereto, the first leg extending in a direction opposite to the second leg, the second leg terminating in the U-shaped configuration to receive the peripheral end portion of the outer dome therein, the first leg being mounted on the sealing means, and at least one weep hole formed in the second leg.

6. The invention in accordance with claim 1 wherein the supporting frame is coupled to said dome and sealing means arrangement in position to support the assembly in response to tension loads placed thereon.

7. The invention in accordance with claim 1 wherein adjustment means is provided to facilitate adjustment of the assembly at the location of use.

8. A skylight assembly adapted to be mounted to cover an opening in a roof structure comprising; a liner adapted to be mounted adjacent the edge of the opening in the roof structure around the periphery to surround the opening and to form a wall extending upward from the roof structure, an outer dome and an inner dome spaced from one another and with the outer dome overlying the inner dome, both of said domes engaging sealing means positioned on the liner wall, a supporting frame coupled to said dome and sealing means arrangement and the frame and arrangement being hinged to said liner to permit shifting thereof with respect to the liner between a closed position overlying the opening in the roof structure and an open position permitting access to the opening from the exterior of the roof structure, the supporting frame having a U-shaped end portion to receive the peripheral edge portion of the outer dome therein and thereby support the outer dome, the frame being formed with an elongated central base, a first leg extending from one transverse edge of the base along the length thereof and perpendicular thereto, a second leg extending from the other transverse edge of the base along the length thereof and perpendicular thereto, the first leg extending in a direction opposite to the second leg, the second leg terminating in the U-shaped configuration to receive the peripheral end portion of the outer dome therein, the first leg being mounted on the sealing means, at least one weep hole formed in the second leg, the supporting frame being formed of two L-shaped members with a leg of one L-shaped member overlying a leg of the other L-shaped member to form the base portion of the supporting frame, and the overlying legs of the L-shaped members being adjustably fastened by means of at least one fastener assembly.

* * * * *

UNITED STATES PATENT AND TRADEMARK OFFICE

CERTIFICATE OF CORRECTION

PATENT NO. : 4,408,422

DATED : October 11, 1983

INVENTOR(S) : Stephen K. Bechtold

It is certified that error appears in the above-identified patent and that said Letters Patent are hereby corrected as shown below:

Column 4, line 10, after "skylight" should read as --22--.

Signed and Sealed this

Twentieth Day of December 1983

[SEAL]

*Attest:*

GERALD J. MOSSINGHOFF

*Attesting Officer*

*Commissioner of Patents and Trademarks*